US007189090B2

(12) United States Patent
Aizawa et al.

(10) Patent No.: US 7,189,090 B2
(45) Date of Patent: Mar. 13, 2007

(54) COUPLER FOR FLAT CABLES AND ELECTRICAL CONNECTOR ASSEMBLY

(75) Inventors: Masayuki Aizawa, Tokyo (JP); Akira Kubo, Tokyo (JP); Isao Igarashi, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/261,881

(22) Filed: Oct. 28, 2005

(65) Prior Publication Data

US 2006/0094284 A1 May 4, 2006

(30) Foreign Application Priority Data

Oct. 29, 2004 (JP) ..... 2004-315554

(51) Int. Cl.
*H01R 13/15* (2006.01)

(52) U.S. Cl. ..... 439/260; 439/637; 439/495

(58) Field of Classification Search ..... 439/607, 439/422, 497, 495, 260, 637
See application file for complete search history.

(56) References Cited

U.S. PATENT DOCUMENTS 3,587,029 A * 6/1971 Knowles ..... 439/607
4,773,878 A * 9/1988 Hansell, III ..... 439/497
4,971,574 A * 11/1990 Garcia ..... 439/497
5,035,632 A * 7/1991 Rudoy et al. ..... 439/108
5,679,018 A * 10/1997 Lopata et al. ..... 439/260
6,004,151 A * 12/1999 Hashiguchi ..... 439/260
6,036,519 A * 3/2000 Lopata et al. ..... 439/260
6,123,582 A * 9/2000 Ko et al. ..... 439/579
6,139,363 A * 10/2000 Ko et al. ..... 439/579
6,152,771 A * 11/2000 Juntwait ..... 439/607
6,183,281 B1 * 2/2001 Wu et al. ..... 439/260
6,338,652 B1 * 1/2002 Ko ..... 439/579
6,475,024 B1 * 11/2002 Narui ..... 439/495
6,655,992 B1 * 12/2003 Ko ..... 439/579
6,676,444 B2 * 1/2004 Noro ..... 439/579
6,705,893 B1 * 3/2004 Ko ..... 439/607
6,733,310 B2 * 5/2004 Fujikura et al. ..... 439/95
6,793,527 B2 * 9/2004 Noro ..... 439/579
6,796,803 B2 * 9/2004 Abe ..... 439/62
6,902,425 B2 * 6/2005 Huang ..... 439/495
7,001,208 B2 * 2/2006 Huang ..... 439/495

FOREIGN PATENT DOCUMENTS

JP 9-330772 12/1997
JP 2000-268904 9/2000

* cited by examiner

*Primary Examiner*—Tulsidas C. Patel
*Assistant Examiner*—Harshad C Patel
(74) *Attorney, Agent, or Firm*—Barley Snyder LLC

(57) ABSTRACT

A coupler for an electrical connector assembly includes first and second holding members that mate to fix a flexible flat cable therebetween. At least one of the first or second holding members has an inner surface provided with a metallic shell that contacts an exposed grounding member of the flexible flat cable. The metallic shell has a contact member extending therefrom that engages a metallic shielding shell on a housing of an electrical connector.

19 Claims, 10 Drawing Sheets

COUPLER FOR FLAT CABLES AND ELECTRICAL CONNECTOR ASSEMBLY

FIELD OF THE INVENTION

The invention relates to a coupler that is mounted on a leading end of a flexible flat cable (FFC) that is connected to an electrical connector and an electrical connector assembly comprising the same.

BACKGROUND OF THE INVENTION

To electrically connect a FFC to an electrical connector mounted on a circuit board, a leading end of the FFC is inserted into the electrical connector so that electrodes formed at the leading end of the FFC come into contact with contacts of the electrical connector. Because the FFC is flexible, however, it is difficult to confirm whether the FFC has been fully or properly inserted into the electrical connector.

In order to solve this problem, Japanese Unexamined Patent Publication No. 9(1997)-330772 discloses a rigid cable holder. The cable holder is mounted to a leading end of a FFC to facilitate the handling thereof and to prevent incomplete insertion during attachment of the FFC to an electrical connector. In addition, Japanese Unexamined Patent Publication No. 2000-268904 discloses an electrical connector having a rigid housing that is separable into two halves. One of the halves is mounted to a leading end of an FFC. The halves of the housing are then engaged with each other thereby improving the tactile sensation of insertion and preventing faulty connections.

In the above-described examples, however, a continuous electromagnetic shield cannot be formed between the FFC and the electrical connector. The exposed portion between the FFC and the electrical connector is therefore likely to radiate spurious electromagnetic waves or be subject to adverse influence by external electromagnetic waves.

BRIEF SUMMARY OF THE INVENTION

It is therefore an object of the invention to provide a coupler for a FFC wherein the coupler imports rigidity to a leading end of the FFC to prevent faulty connections during insertion into an electrical connector while forming a continuous electromagnetic shield from the FFC to the electrical connector and eliminating ground loops.

This and other objects are achieved by an electrical connector assembly comprising an electrical connector, a flexible flat cable, and a coupler. The electrical connector has an insulative housing with a contact receiving opening. A metallic shielding shell is provided on the housing. The coupler includes first and second holding members that mate to fix a flexible flat cable therebetween. At least one of the first or second holding members has an inner surface provided with a metallic shell that contacts an exposed grounding member of the flexible flat cable. The metallic shell has a contact member extending therefrom that engages the metallic shielding shell.

This and other objects are further achieved by a coupler for a flexible flat cable, comprising first and second holding members that receive the flexible flat cable therebetween. At least one of the first or second holding members having an inner surface provided with a metallic shell that contacts an exposed grounding member of the flexible flat cable.

DETAILED DESCRIPTION OF THE INVENTION

FIGS. 1A–9 show an electrical connector assembly comprising a FFC 1, a coupler 2, and an electrical connector 100 according to a first embodiment of the invention. It will be appreciated by those skilled in the art that although the electrical connector assembly described herein is described as being used with the FFC 1, in which a plurality of wires are arranged substantially parallel within a planar insulator, that alternatively a flexible printed circuit (FPC), in which conductive paths are printed on a flexible substrate, may be used.

Figure 1A:
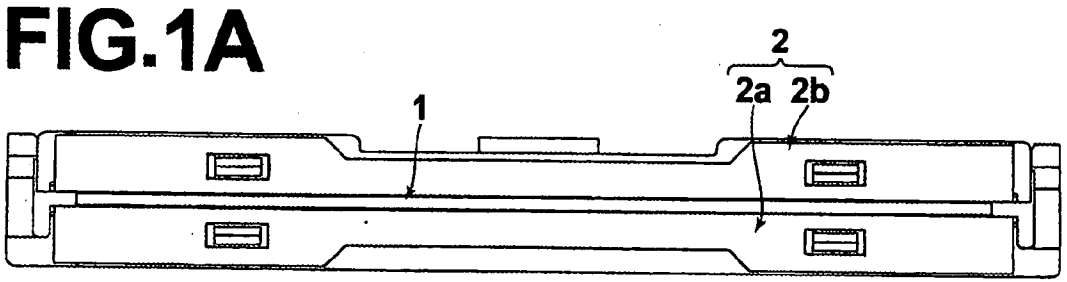
FIG. 1A is a front view of a coupler with a FFC.
Figure 1B:
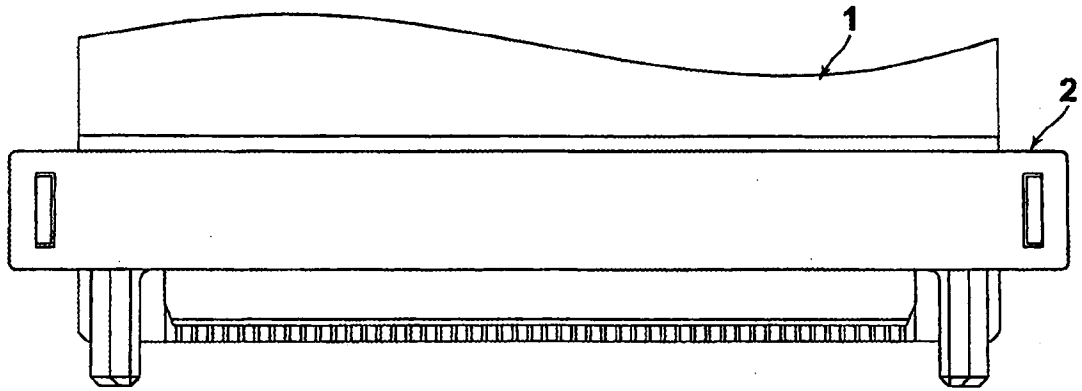
FIG. 1B is a plan view of the coupler with the FFC.
Figure 1C:
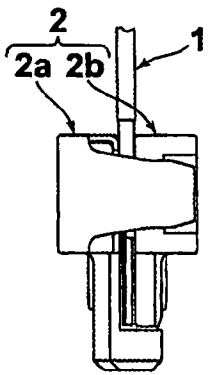
FIG. 1C is a right side view of the coupler with the FFC.

As shown in FIGS. 1A–1C, the coupler 2 comprises a first holding member 2*a* and a second holding member 2*b*. The first holding member 2*a* and the second holding member 2*b* are formed to receive a leading end of the FFC 1 therebetween when mated. The coupler 2 has a length such that the FFC 1 is held between the first holding member 2*a* and the second holding member 2*b* across the entire width thereof.

Figure 2A:
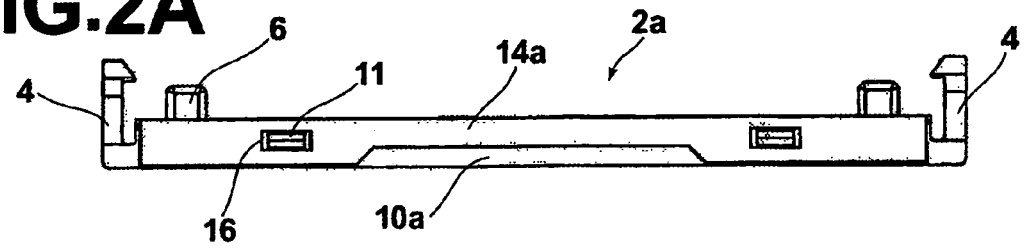
FIG. 2A is a front view of a first holding member of the coupler.
Figure 2B:
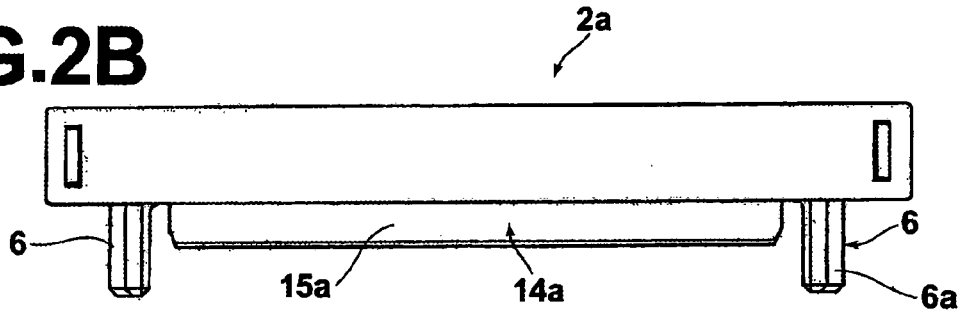
FIG. 2B is a plan view of the first holding member of the coupler.
Figure 2C:
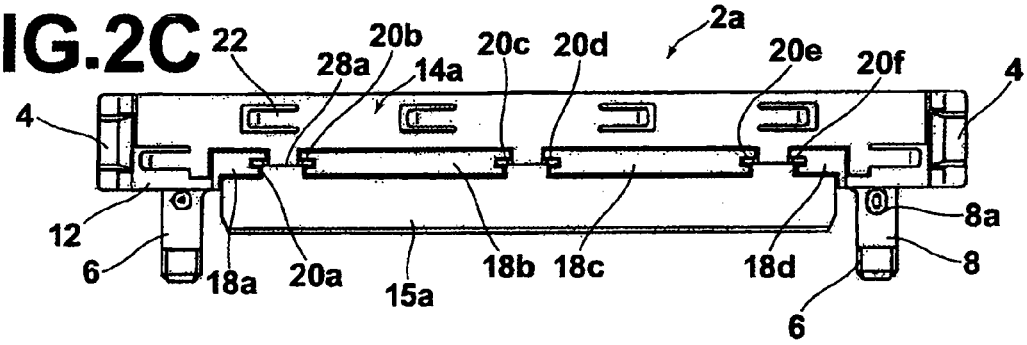
FIG. 2C is a bottom view of the first holding member of the coupler.
Figure 2D:
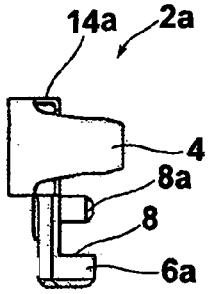
FIG. 2D is a right side view of the first holding member of the coupler.

As shown in FIGS. 2A–2D, the first holding member 2*a* is a substantially elongated plate. Latch arms 4 extend from ends of the first holding member 2*a*. Guide members 6 extend from ends of the first holding member 2*a* proximate each of the latch arms 4. As shown in FIG. 2D, a key 6*a* is formed at an end of each of the guide posts 6 and extends substantially perpendicular thereto. Each of the guide members 6 has a cutout 8 that extends from proximate the key 6*a* to a base of the guide post 6. An inwardly protruding boss 8*a* is formed within each of the cutouts 8 and extends substantially perpendicular to the guide post 6. As shown in FIG. 2A, a rear surface 10*a* of the first holding member 2*a* has protrusions 11. As shown in FIG. 2C, an inner surface 12 of the first holding member 2*a* has recesses 18*a*, 18*b*, 18*c*, 18*d*.

As shown in FIGS. 2C–2D, a first metallic shell 14*a* is attached to the first holding member 2*a* such that the first metallic shell 14*a* covers the rear surface 10*a* and the inner surface 12 of the first holding member 2*a*. The first metallic shell 14*a* includes openings 16 that correspond to the protrusions 11 of the first holding member 2*a* and engage therewith, as shown in FIG. 2A. As shown in FIG. 2C, the first metallic shell 14*a* includes press fit portions 20*a*, 20*b*, 20*c*, 20*d*, 20*e*, 20*f* that correspond with the recesses 18*a*, 18*b*, 18*c*, 18*d* of the first holding member 2*a* and are press-fit therein. FFC engaging tongue pieces 22 are stamped and formed from the first metallic shell 14*a*. A forward portion of the first metallic shell 14*a* is formed as an inwardly protruding contact member 15*a* via a step 28*a*.

Figure 3A:
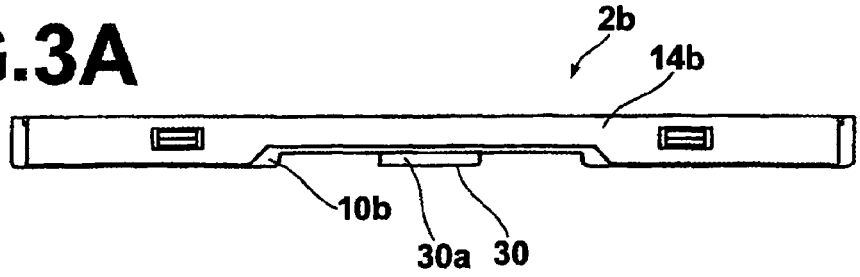
FIG. 3A is a front view of a second holding member of the coupler.
Figure 3B:
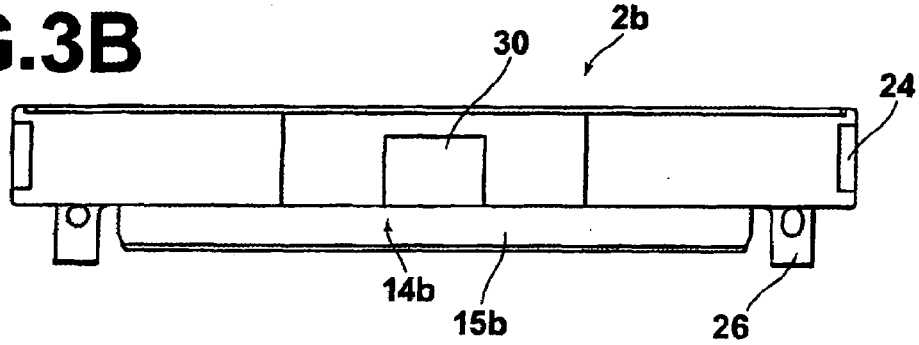
FIG. 3B is a plan view of the second holding member of the coupler.
Figure 3C:
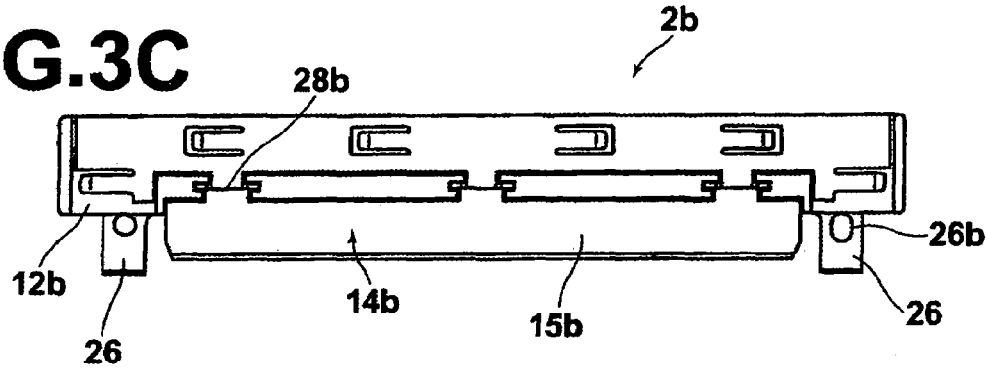
FIG. 3C is a bottom view of the second holding member of the coupler.
Figure 3D:
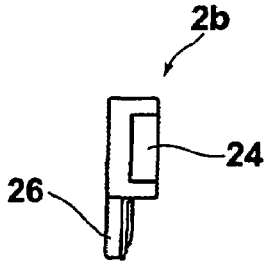
FIG. 3D is a right side view of the second holding member of the coupler.

As shown in FIGS. 3A–3D, the second holding member 2*b* is a substantially elongated plate. As shown in FIGS. 3B and 3D, openings 24 that engage with the latch arms 4 of the first holding member 2*a* are formed at ends of the second holding member 2*b*. Forwardly extending protrusions 26 corresponding to the cutouts 8 of the guide member 6 are formed proximate the ends of the second holding member 2*b*, as shown in FIG. 3C. Each of the protrusions 26 has an aperture 26*b* corresponding to the boss 8*a*. An engaging portion 30, which has an engaging shoulder 30*a* at a rear thereof, is formed at an approximate center in a longitudinal direction of the second holding member 2*b*, as shown in FIG. 3A.

A second metallic shell 14*b* is attached to the second holding member 2*b* such that it covers a rear surface 10*b* and an inner surface 12*b* of the second holding member 2*b*. The second metallic shell 14*b* includes a contact member 15*b* that protrudes inwardly via a step 28*b*.

Figure 4A:
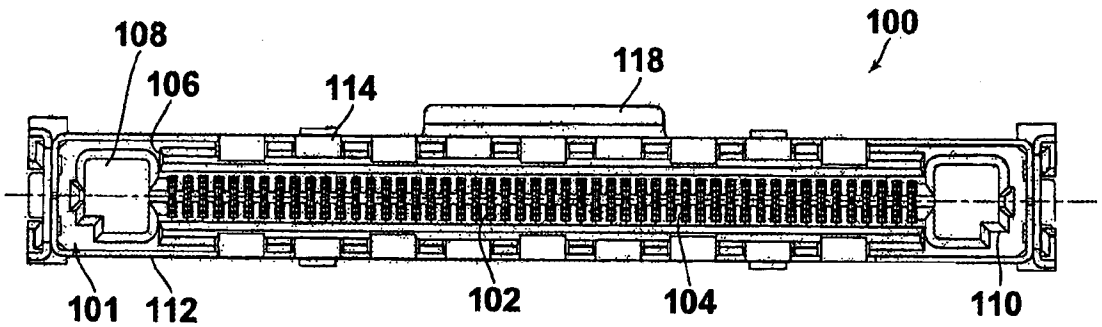
FIG. 4A is a front view of an electrical connector.
Figure 4B:
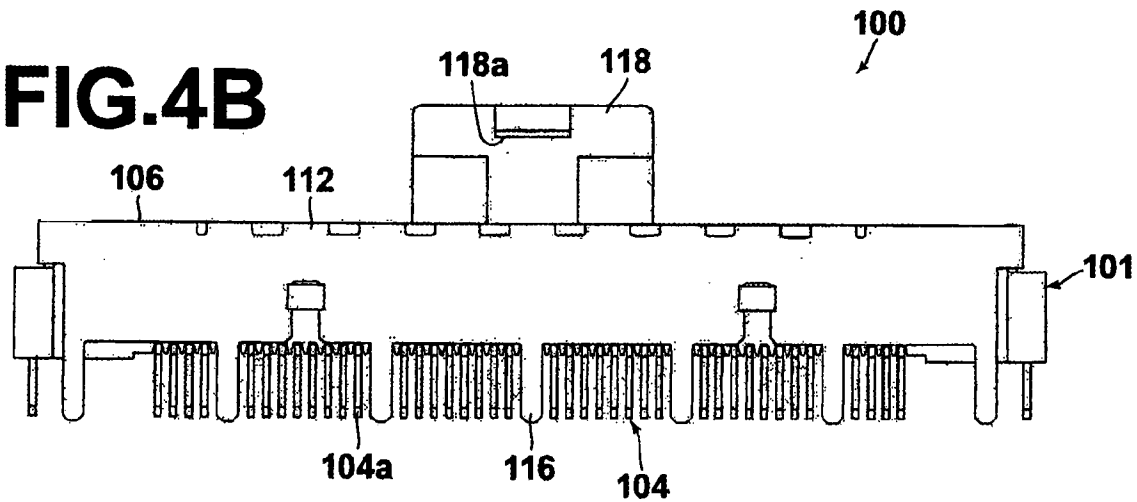
FIG. 4B is a plan view of the electrical connector.
Figure 4C:
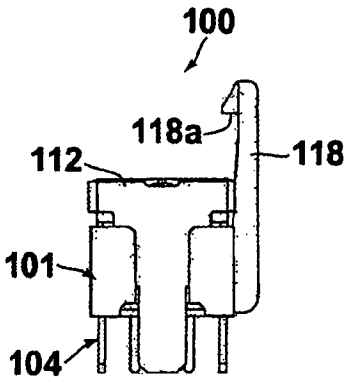
FIG. 4C is a right side view of the electrical connector.

As shown in FIGS. 4A–4C, the electrical connector 100 comprises an insulative housing 101. An elongated contact receiving opening 102 is provided in a forward facing engagement surface 106 of the housing 101, as shown in FIG. 4A. A plurality of contacts 104 are arranged in the contact receiving opening 102 along a longitudinal direction thereof. The contacts 104 have forwardly protruding tines 104*a*, as shown in FIG. 4B. As shown in FIG. 4A, guide member receiving apertures 108 are formed at ends of the housing 101. Keying protrusions 110 protrude inwardly from a periphery of the guide apertures 108 and form a keying structure with the guide members 6 to prevent inverted insertion of the FFC 1 in the electrical connector 100.

As shown in FIGS. 4A–4C, a metallic shielding shell 112 is provided on the housing 101 such that it covers an outer surface of the housing 101 with respect to a longitudinal direction thereof. The shielding shell 112 serves as a grounding member of the electrical connector 100. A plurality of grounding tongues 114 are formed at a predetermined interval at edges of the shielding shell 112 at both sides of the engagement surface 106 such that the grounding tongues 114 extend toward an interior of the contact receiving opening 102, as shown in FIG. 4A. The grounding tongues 114 are formed to contact the first and second metallic shells 14*a*, 14*b* of the coupler 2 to form a shielding structure. The shielding shell 112 has forwardly protruding legs 116. When the electrical connector 100 is mounted onto a circuit board 180 (FIG. 7), the tines 104*a* of the contacts 104 and the legs 116 of the shielding shell 112 are inserted through apertures 181, 182, respectively, in the circuit board 180. An engaging arm 118 extends rearward beyond the engagement surface 106 and is formed at an approximate center with respect to the longitudinal direction of a side of the housing 101. The engaging arm 118 has a forward facing engaging surface 118*a* that engages with the shoulder 30*a* of the engaging portion 30 of the coupler 2 to fix the coupler 2 and the electrical connector 100 to each other.

Figure 5A:
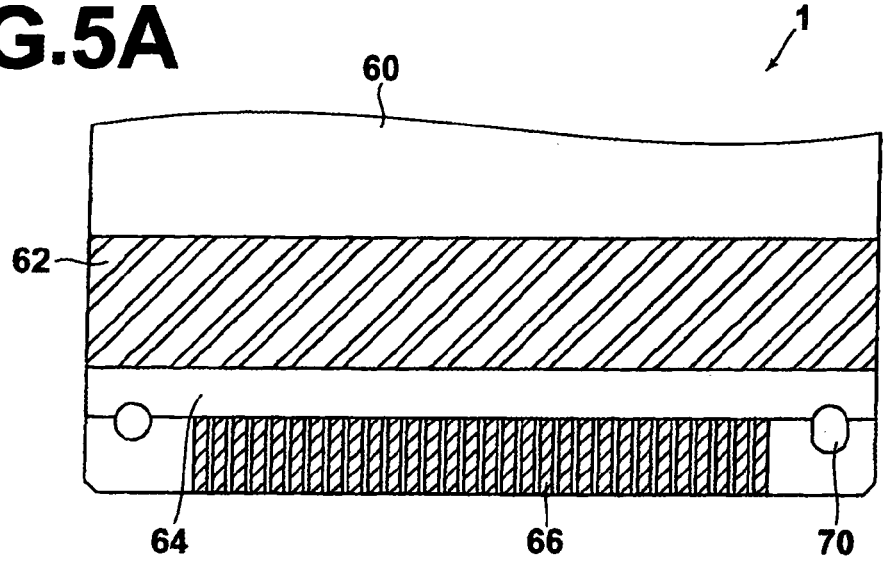
FIG. 5A is a partial top view of a first surface of the FFC.
Figure 5B:
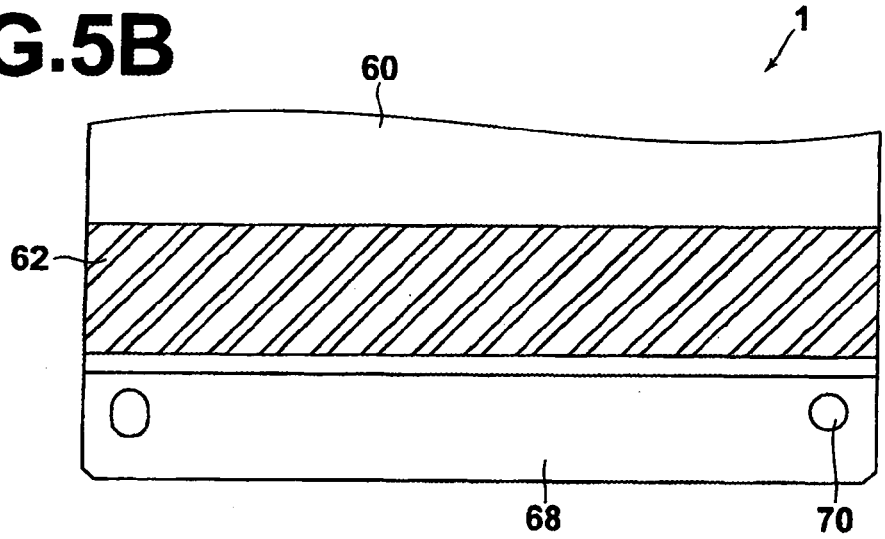
FIG. 5B is a partial top view of a second surface of the FFC.
Figure 6:
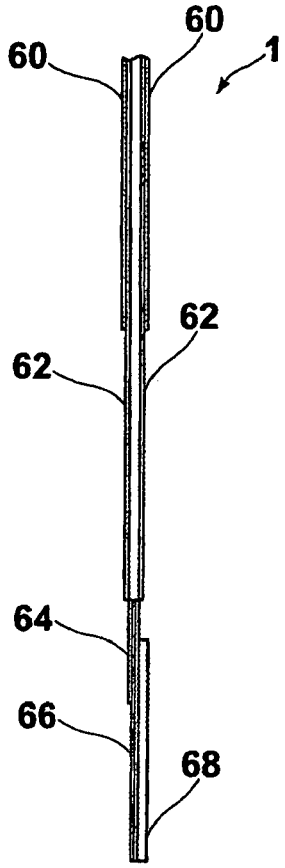
FIG. 6 is a side view of the FFC of FIGS. A–B.

As shown in FIGS. 5A–6, the FFC 1 includes an insulator 64, electrodes 66, and a shielding layer consisting of an aluminum cover 60 and a copper exposed grounding member 62. The aluminum cover 60 forms the outermost layer. The shielding layer covers a plurality of the electrodes 66 with respect to the width of the FFC 1. The side of the aluminum cover 60 that contacts the exposed grounding member 62 and faces the surface of the FFC 1 is insulated. A reinforcing plate 68 is adhesively attached to one side of the leading end of the FFC 1. As shown in FIGS. 5A–5B, apertures 70 are formed at both sides of the leading end of the FFC 1. The apertures 70 correspond to the bosses 8*a* of the first holding member 2*a* of the coupler 2, which are inserted through the apertures 70 to position the coupler 2 relative to the FFC 1.

Figure 7:
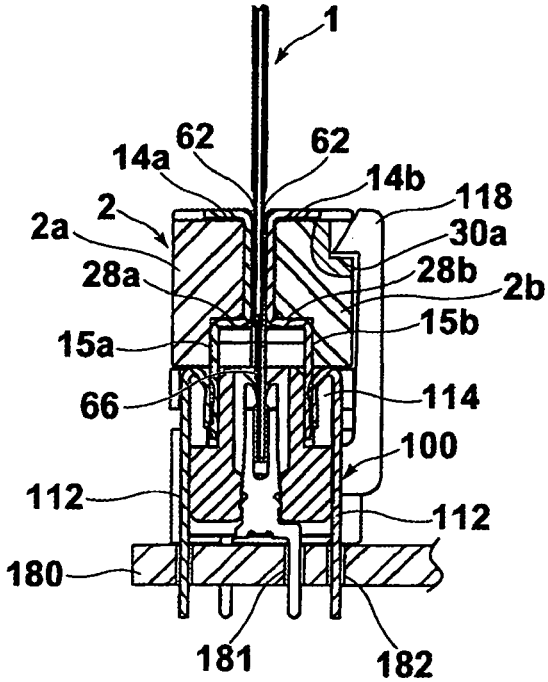
FIG. 7 is a sectional view of an electrical connector assembly according to a first embodiment of the invention.

As shown in FIG. 7, when the coupler 2 is mounted to the FFC 1, the first and second metallic shells 14*a*, 14*b* contact the exposed grounding member 62. The coupler 2 is then inserted into the electrical connector 100 so that the electrodes 66 of the FFC 1 contact the contacts 104 of the electrical connector 100 and electrically connect therewith. The contact members 15*a*, 15*b*, of the first and second metallic shells 14*a*, 14*b*, which are positioned more toward the leading end than the steps 28*a*, 28*b*, open toward the electrodes 66. The contact members 15*a*, 15*b* therefore contact the grounding tongues 114 of the shielding shell 112 to form a continuous electromagnetic shielding structure from the FFC 1 to the shielding shell 112. The engaging arm 118 engages with the shoulder 30*a* of the second holding member 2*b* to prevent extraction of the FFC 1 in a vertical direction.

In the electrical connector assembly according to the first embodiment, the exposed grounding members 62 are provided on both surfaces of the FFC 1, and shielding paths are provided on both sides of the FFC 1 via the first and second metallic shells 14*a*, 14*b*, which are provided on both sides of the coupler 2. It is therefore not necessary for the electromagnetic shielding structure to circumvent the FFC 1 from one exposed portion 62 to the other exposed portion 62 therefore eliminating the ground loop. Additionally, the shielding structure can be formed over a comparatively large area from the FFC 1 to the electrical connector 100.

Figure 8A:
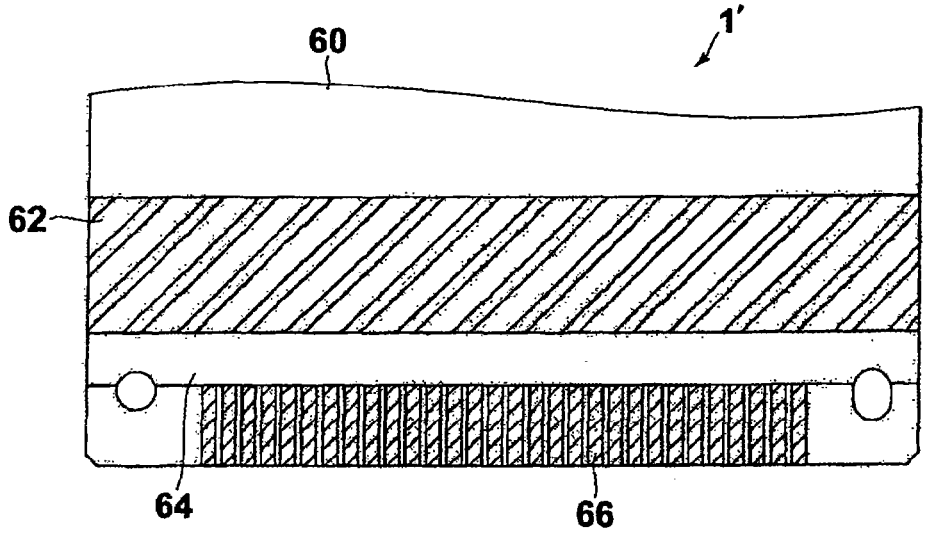
FIG. 8A is a top view of a first surface of a modified FFC.
Figure 8B:
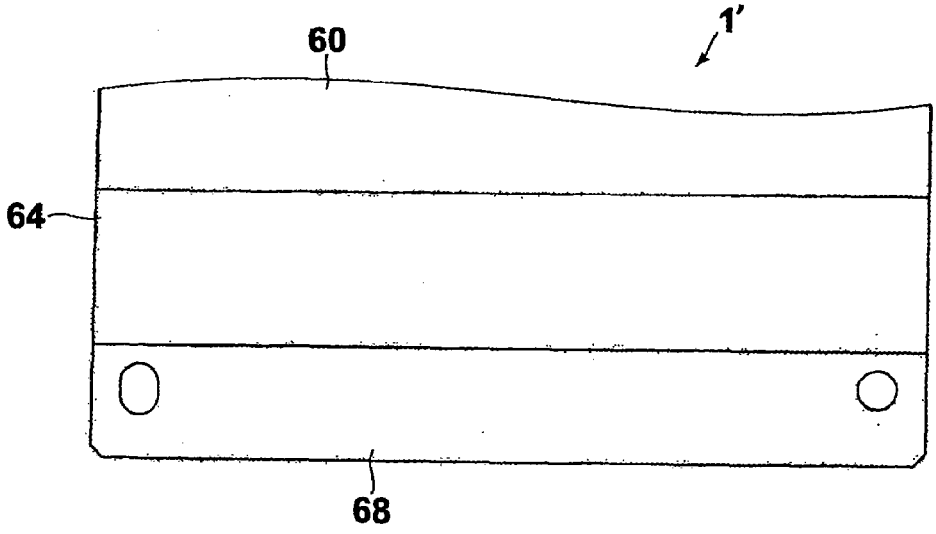
FIG. 8B is a top view of a second surface of the modified FFC.
Figure 9:
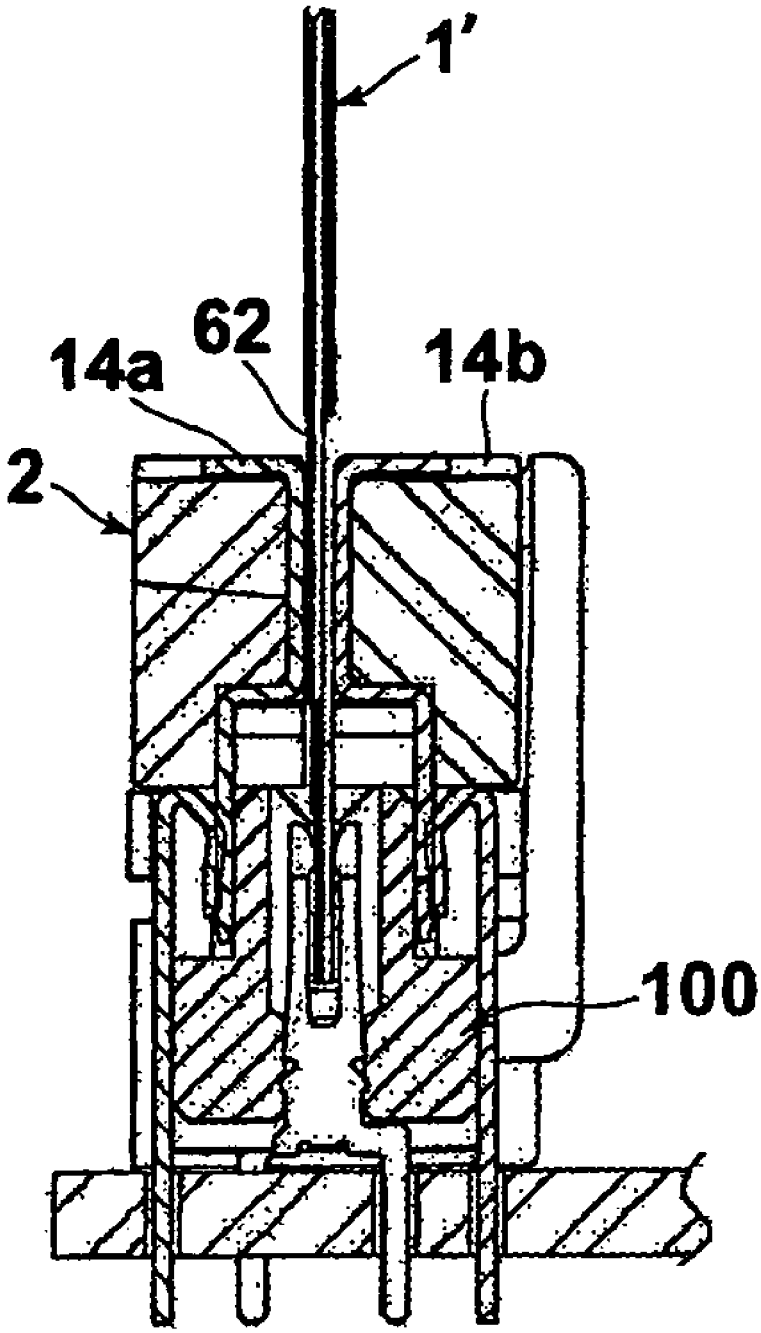
FIG. 9 is a sectional view of an electrical connector assembly with the modified FFC.

FIGS. 8A–8B show a modified FFC 1'. Elements of the modified FFC 1' that are identical to elements of the FFC 1 will be described using the same reference numerals and will not be explained in further detail. As shown in FIG. 8A, a first surface of the FFC 1' is provided with the aluminum covering 60, the exposed grounding member 62, the insulator 64, and the electrodes 66. Similar to the FFC 1, the aluminum cover 60 forms the outermost layer. However, the exposed grounding member 62 is not formed on a second surface of the FFC 1' that is opposite from the first surface, as shown in FIG. 8B. As shown in FIG. 9, when the coupler 2 is mounted to the FFC 1', because the exposed grounding member 62 is only formed on the first surface and not the second surface of the FFC 1', even if the first and second metallic shells 14*a*, 14*b* are provided on both sides of the coupler 2, an electromagnetic shielding structure is formed only at the first surface of the FFC 1' from the coupler 2 to the electrical connector 100.

Figure 10A:
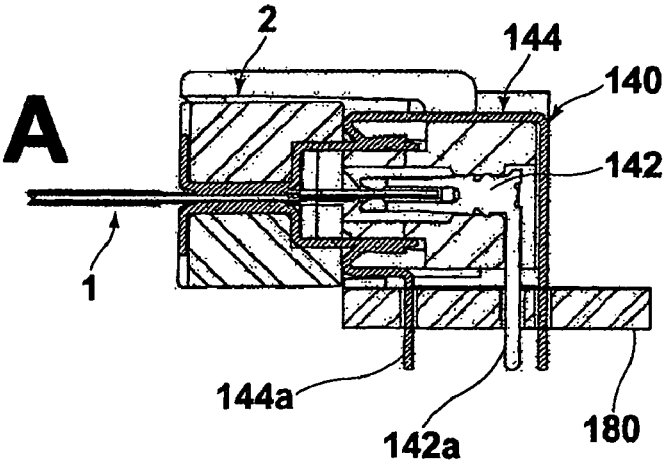
FIG. 10A is a sectional view of an electrical connector assembly according to a second embodiment of the invention.

FIG. 10A shows a second embodiment of an electrical connector assembly according to the invention. Elements of the second embodiment that are identical to elements of the first embodiment will be described using the same reference numerals and will not be explained in further detail. Unlike the first embodiment where the electrical connector 100 is mounted vertically on the circuit board 180, in the second embodiment, electrical connector 140 is mounted horizontally on the circuit board 180 such that an engagement surface of the electrical connector extends substantially parallel to the circuit board 180. The electrical connector 140 has contacts 142 and a shielding shell 144. Tines 142*a* of the contacts 142 and legs 144*a* of the shielding shell 144 extend substantially perpendicular to the circuit board 180. The shielding structure of the electrical connector assembly of the second embodiment, however, is assembled in substantially the same manner as the electrical connector assembly of the first embodiment.

Figure 10B:
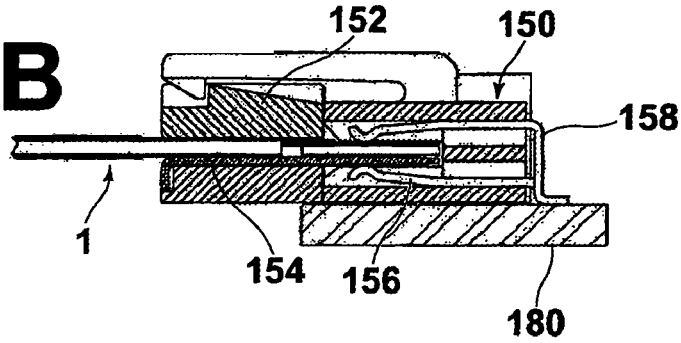
FIG. 10B is a sectional view of an electrical connector assembly according to a third embodiment of the invention.

FIG. 10B shows a third embodiment of an electrical connector assembly according to the invention. Elements of the third embodiment that are identical to elements of the first embodiment will be described using the same reference numerals and will not be explained in further detail. The electrical connector assembly according to the third embodiment comprises an electrical connector 150 mounted using surface mount technology. A coupler 152 has a first metallic shell 154, which is provided on only one side of the coupler 152. The first metallic shell 154 is connected to a shielding shell 156. Electrodes are respectively connected to contacts 158. Accordingly, a shielding structure is formed only on one side of the FFC 1.

Figure 10C:
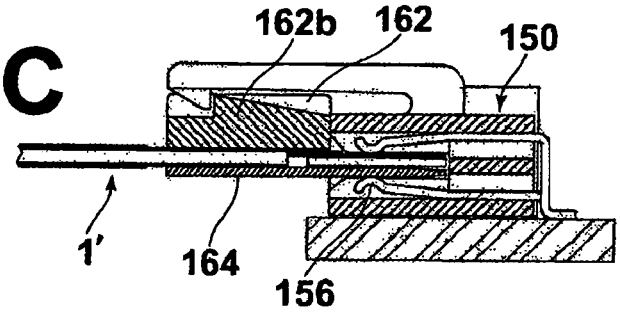
FIG. 10C is a sectional view of an electrical connector assembly according to a fourth embodiment of the invention.
Figure 10D:
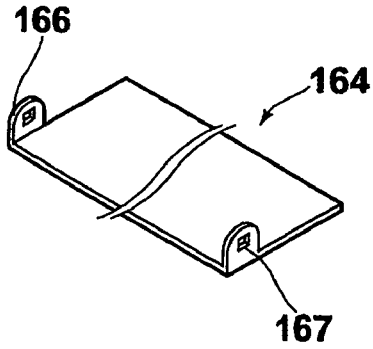
FIG. 10D is a perspective view of a metallic shell of the electrical connector assembly of FIG. 1C.

FIGS. 10C–10D show a fourth embodiment of an electrical connector assembly according to the invention. Elements of the fourth embodiment that are identical to elements of the first embodiment will be described using the same reference numerals and will not be explained in further detail. As shown in FIG. 10C, the electrical connector assembly according to the fourth embodiment comprises the connector 150 mounted using surface mount technology. A coupler 162, in which the FFC 1 is mounted, comprises a first holding member. The other side of the coupler 162 comprises a metallic shell 164, as shown in FIG. 10D. In other words, the metallic shell 164 forms a second holding member of the coupler 162.

As shown in FIG. 10D, the metallic shell 164 is an elongated metal plate. Engaging tongues 166 are formed at both ends of the metallic shell 164. The engaging tongues 166 have apertures 167 for engaging protrusions formed in a metallic shell connecting member 162*b* to fix the metallic shell to the coupler 162, as shown in FIG. 10C. The engaging tongues 166 may be formed, for example, by bending the metal plate at both ends thereof. The metallic shell 164 is connected to the shielding shell 156, in the same manner as the third embodiment of the invention.

Figure 11:
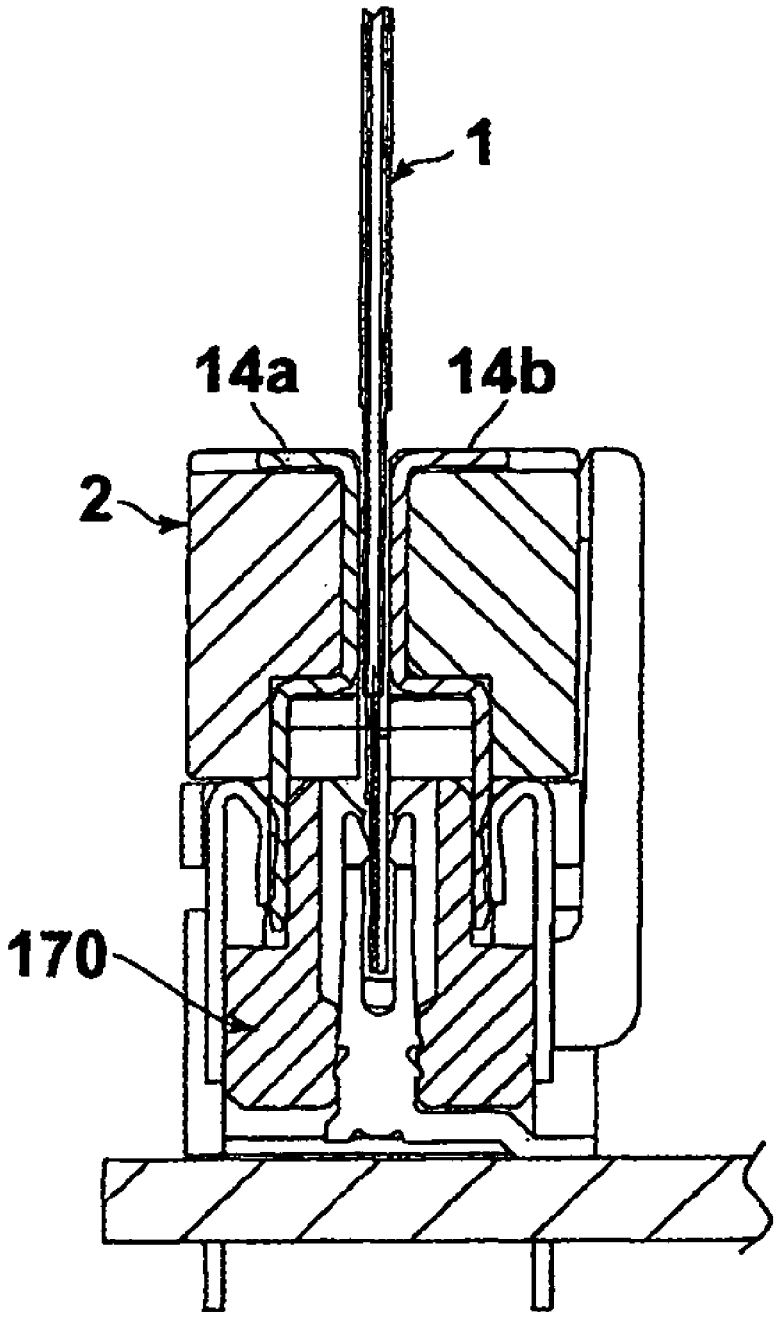
FIG. 11 is a sectional view of an electrical connector assembly according to a fifth embodiment of the invention.

FIG. 11 shows a fifth embodiment of an electrical connector assembly according to the invention. Elements of the fifth embodiment that are identical to elements of the first embodiment will be described using the same reference numerals and will not be explained in further detail. As shown in FIG. 1, the electrical connector assembly according to the fifth embodiment comprises a connector 170 having surface mounted contacts. Because the connector 170 of the fifth embodiment is assembled with the coupler 2 and the FFC 1 in the same as the second embodiment and the shielding structure functions in substantially the same manner as the shielding structure of the second embodiment, further description thereof has been omitted.

In the electrical connector assemblies according to the embodiments described herein, rigidity is imparted to the leading end of the FFC 1, 1' by the coupler 2, 152, 162, thereby preventing faulty connections during insertion of the FFC 1, 1' into the electrical connector 100, 150, 170. Because recognition of engagement between the FFC 1, 1' and the electrical connector 100, 150, 170 occurs, disengagement of the FFC 1, 1' and the electrical connector 100, 150, 170 due to vibrations and impacts is prevented. Additionally, inverted insertion of the FFC 1, 1' is prevented by the guide posts 6, which prevents pitch shifts of the electrodes 66 and/or short circuits. Contact points, which are interposed between the flat cable and the electrical connector, are also eliminated. In addition, it is possible to form a continuous shield from the FFC 1, 1' to the electrical connector 100, 150, 170.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A coupler configured for receipt of a flexible flat cable, comprising:

insulative first and second holding members, the first holding member being mateable with the second holding member such that the flexible flat cable is held there between;

a first metallic shell fixed to an inner surface of the first holding member, the first metallic shell being configured to contact an exposed grounding member on a first side of the flexible flat cable; and a second metallic shell fixed to an inner surface of the second holding member, the second metallic shell being configured to contact an exposed grounding member on a second side of the flexible flat cable.

2. The coupler of claim 1, wherein a contact member extends from the first and second metallic shells away from the coupler.

3. The coupler of claim 1, wherein engaging tongue pieces extend from the first and second metallic shells toward the exposed grounding members.

4. The coupler of claim 1, wherein the coupler includes an engaging portion for engaging with an electrical connector.

5. The coupler of claim 1, further comprising guide members that extend from the coupler.

6. The coupler of claim 1, wherein the first and second metallic shells includes press-fit portions that attach the first and second metallic shells to the first and second holding members.

7. The coupler of claim 1, wherein the first and second holding members are substantially elongated plates.

8. An electrical connector assembly for a flexible flat cable, comprising:

an electrical connector having an insulative housing provided with a contact receiving opening having a plurality of contacts;

a metallic shielding shell fixed to the housing;

a coupler inserted in the electrical connector, the coupler including insulative first and second holding members, the first holding member being mateable with the second holding member such that the flexible flat cable is held there between;

a first metallic shell fixed to an inner surface of the first holding member, the first metallic shell being configured to contact an exposed grounding member on a first side of the flexible flat cable and the metallic shielding shell; and a second metallic shell fixed to an inner surface of the second holding member, the second metallic shell being configured to contact an exposed grounding member on a second side of the flexible flat cable and the metallic shielding shell.

9. The electrical connector assembly of claim 8, wherein engaging tongue pieces extend from the first and second metallic shells toward the exposed grounding members.

10. The electrical connector assembly of claim 8, wherein the metallic shielding shell extends into the contact receiving opening.

11. The electrical connector assembly of claim 8, wherein the coupler includes an engaging portion that fixes the coupler to the electrical connector.

12. The electrical connector assembly of claim 8, wherein the coupler includes at least one guide member that guides the coupler and the flexible flat cable into engagement with the electrical connector.

13. The electrical connector assembly of claim 8, wherein the metallic shielding shell has legs for contacting a circuit board.

14. The electrical connector assembly of claim 8, wherein the first and second holding members are substantially elongated plates.

15. The electrical connector assembly of claim 8, wherein the first and second metallic shells includes press-fit portions that attach the first and second metallic shells to the first and second holding members.

16. An electrical connector assembly, comprising:

a flexible flat cable having electrodes, the flexible flat cable having exposed grounding members on a first and second side of the flexible flat cable;

a coupler including first and second holding members, the first holding member being mateable with the second holding member to hold the flexible flat cable there between;

a first metallic shell fixed to an inner surface of the first holding member, the first metallic shell contacting the exposed grounding member on the first side of the flexible flat cable; and a second metallic shell fixed to an inner surface of the second holding member, the second metallic shell contacting the exposed grounding member on the second side of the flexible flat cable.

17. The electrical connector assembly of claim 16, further comprising an electrical connector having an insulative housing provided with a plurality of contacts, the coupler being inserted into the housing to electrically connect the electrodes to the contacts.

18. The electrical connector assembly of claim 17, further comprising a metallic shielding shell fixed to the housing, the metallic shielding shell contacting the first and second metallic shells.

19. The electrical connector assembly of claim 16, wherein the exposed grounding member on the first side is part of a shielding layer and the exposed grounding member on the second side is part of another shielding layer, the shielding layers being mutually isolated.

* * * * *